United States Patent [19]

Mocarski

[11] 4,382,818

[45] May 10, 1983

[54] METHOD OF MAKING SINTERED POWDER ALLOY COMPACTS

[75] Inventor: Stanislaw Mocarski, Windsor, Canada

[73] Assignee: Ford Motor Company, Dearborn, Mich.

[21] Appl. No.: 938,675

[22] Filed: Aug. 31, 1978

Related U.S. Application Data

[63] Continuation-in-part of Ser. No. 638,783, Dec. 8, 1975, abandoned, which is a continuation-in-part of Ser. No. 535,527, Dec. 23, 1974, abandoned, and Ser. No. 403,240, Oct. 3, 1973, abandoned.

[51] Int. Cl.[3] ..... B22F 1/02; B22F 3/16

[52] U.S. Cl. ..... 419/11

[58] Field of Search ..... 75/211, 200, 201, 212, 75/213

[56] References Cited

U.S. PATENT DOCUMENTS

| | | | |
|---|---|---|---|
| 2,238,382 | 4/1941 | Boegehold | 75/200 X |
| 2,856,281 | 10/1958 | Cremer et al. | 75/134 M |
| 3,689,257 | 9/1972 | Oda et al. | 75/200 X |

*Primary Examiner*—Richard D. Lovering

*Attorney, Agent, or Firm*—Joseph W. Malleck; Olin B. Johnson

[57] ABSTRACT

A process for improving alloying efficiency in making powder alloy sintered compacts is disclosed. A master alloy (non-iron-based) powder is formulated for admixture in small amounts (2.5–6.0%) to a relatively pure iron based powder and free carbon powder to provide liquid phase sintering and production of a substantially homogeneous product having the characteristics of a wrought alloy product. The master alloy powder is inert gas atomized and chemically constituted to contain at least two elements selected from the group consisting of and in the percentage ranges for the alloy powder of manganese (40–72%), nickel (12–30%), molybdenum (5–11%), chromium (3–20%), copper and iron (1–40%. The master alloy powder may contain additions of a wetting agent, silicon up to 3% and rare earth metals up to 2%, either of which assist to speed up diffusion and create a more favorable liquidus-solidus relationship within the master alloy powder. The iron-based powder is water atomized and annealed to contain less than 1% impurities. The admixture is compacted and heated in a protective atmosphere to a temperature in the range of 1900–2250 to facilitate liquidification only of the master alloy powder for diffusion into the base iron powder and thus provide sintering.

18 Claims, 3 Drawing Figures to heat treatment, a critical aspect of preparing powder preforms).

After the benefits of admixing pure copper were discovered, a binary copper admixture containing 35% manganese and 65% copper was designed and investigated as a mixing agent for a base steel powder; the binary alloy powder mixture melted at 1590° F. (868° C.). The diffusion occurred at a lower temperature and much more rapid pace than when pure copper alone was admixed. From this it was theorized that ternary and quaternary powder alloy mixes of copper and manganese, along with nickel and/or molybdenum could be prepared to provide the liquid phase, the master alloy mix then being balanced in an amount to obtain a desired liquid fused precompact when mixed and heated with steel or iron base powder which does not melt. However, with further experimentation it was found that copper in larger percentages was not compatible with molybdenum for purposes of liquid phase sintering, and presence of iron was required to lower the melting temperature when molybdenum and/or chromium was present. These refractory metals have a high melting point; Mo-4754° F. (2623° C.) and Cr-3389° F. (1863° C.). It was also found that it was important that the addition of the alloying ingredients be critically controlled so as to produce a narrow and relatively low sintering temperature range (1800–2500° F.).

It was discovered that a successful multicomponent master alloy mixture (Designated No. 342) derived from metal melted under inert gas, gas atomized, and screened to a −200 mesh size and having the following chemical analysis provided an initially satisfactory liquidus and melting range within 350° F.: nickel 28.20%, iron 10.52%, manganese 40.78%, molybdenum 5.37%, and chromium 15.15%. This master alloy mixture must be added in very small amounts to a base iron powder having a purity of >99% (obtained economically by water atomization), the addition here being 2½% by weight, together with natural graphite in four different proportions, and after being subjected to a conventional technique of precompacting, sintering in hydrogen atmosphere at 2250° F. and hot forming at 1800° F. (982° C.) the resulting steels contained a final composition of 1.0% manganese, 0.03% copper, 0.82% nickel, 0.14% molybdenum, 0.42 chromium, the remainder iron. The master alloy mixture had a liquidus of 2140° F. (1171° C.) and a solidus of 1830° F. (999° C.) during heating, producing a 310° F. (172° C.) melting range which is deemed usable for commercial applications.

Electron microprobe analysis was performed on the hot formed preforms compacted to a density of 99+% using a 2½% master alloy powder in an iron based powder, the master alloy powders included, as candidates, the above described alloy powders No. 342 and 400 given in Table I. It was observed that for the ingredients associated with the processing conditions used in the No. 342 experiment, the relative speed of diffusion was highest for the manganese, while the diffusion of molybdenum, nickel and chromium was only approximately one third that of manganese. Manganese gave a very narrow spread or deviation in the microcomposition and is the most desirable element when using liquid phase powder alloying. It was also observed that the lower the melting temperature, the better the wetting action and fluidity of the master alloy and the better the homogeneity of the final product.

In search for an additional improvement to the wetting action, silicon and rare earth metals additions were made to several master alloy powders. The improvement of diffusion by an addition of only 1½% of silicon was surprising. Two heats of alloy powder No. 400 were made, one (No. 400) without silicon and another (No. 400S) with 1½% silicon. Both were made using the same melting method under inert gas and used inert gas atomizing. In a liquid diffusion test, the 400S alloy powder exhibited twice as deep penetration into the iron powder as the alloy powder without silicon. A rare earth metal addition was beneficial to the liquidus-solidus relation, particularly in the presence of silicon. The mechanism of optimum improvement in diffusion is not known but it might be due to silicon reacting with residual oxide films present on the metal.

Some other advantageous (and some not) multi-element alloys are summarized in Table I (see 524, 533, 534, 535 series, Alloy No. 524 exhibiting the lowest liquidus and solidus—the respective values being 2065° F. (1169° C.) and 1730° F. (943° C.), melting range between 335° F. (186° C.). Alloy powder 524 had five times deeper penetration into the iron than the alloy powders No. 342 and No. 400 during the liquid diffusion test run under the same conditions for all the alloy powders.

Following the multi-alloy success, as described further in alloy admixture examples, binary alloys of nickel-manganese (25% Ni, 75% Mn, Alloy No. 528) were tested and additions of silicon, rare earth metals, or yttrium were also found beneficial. As nickel is a slow diffuser and forms "patches" of retained austenite at lower processing temperatures, copper was substituted for a portion of nickel. Copper was found to improve penetration and wetting action, but to a smaller extent than silicon. Thus in alloys without chromium and molybdenum, the composition (527M) 72% Mn; 13.5% Ni; 12.5% Cu; 2% Si; 1% rare earth metals is advantageous.

Master alloy series 344–346 and 506–515 (all quaternary) explored the possibility of lowering nickel and/or chromium without special wetting agents, but the liquids temperature and melting range were not as good as Alloy 533. The binary alloy series 527, 528, 531 and 532 demonstrated an excellent liquidus and melting range.

Physical properties of powder metal steels for any heavy duty application, similar to conventional steels, depend upon good response to heat treatment and resultant microstructure also cleanliness of material as regards non-metallic inclusions. Response of material to heat treatment is measured by hardenability. Hardenability of the resulting iron compact is expressed as Ideal Diameter ($D_I$) which depends on the multiplying factors of alloying ingredients according to the formula:

$$D_I = C_f \times M_{fMo} \times M_{fMn} \times M_{fCr} \times M_{fNi}$$

$D_I$ is the diameter of the bar which will harden in the center to 50% martensite. The most powerful elements contributing to hardenability are molybdenum, manganese, then chrominum makes an intermediate contribution, nickel contributing very little at lower percentage level. Data regarding multiplying factors vary considerably in literature, and these might not be fully applicable to powder metal steels, as silicon content in powder metal usually is less than 0.02%. The molybdenum multiplying factor is typically cited as 1.8 at low carbon levels used in steels for carburizing, but the same factor is 2.6 at high carbon levels, corresponding to the carbon in a carburized case. Thus, depending upon the particular application, the master alloy steel powder has to be

METHOD OF MAKING SINTERED POWDER ALLOY COMPACTS

CROSS REFERENCE TO RELATED APPLICATION

This application is a continuation-in-part of my copending application Ser. No. 638,783 filed Dec. 8, 1975, and now abandoned, which in turn is a continuation-in-part of my previous applications, Ser. No. 535,527 filed Dec. 23, 1974, and now abandoned, and Ser. No. 403,240, filed Oct. 3, 1973, and now abandoned.

BACKGROUND OF THE INVENTION

Consideration as to producing sufficiently homogeneous, hardenable low alloy powdered steel for processing as preforms for hot forming or as sintered shapes involves either or both of two procedures: pre-alloying or admixing. 100% pre-alloyed powders are currently in use as the basic material for low-alloy steel preforms or compacted shapes because of their homogeneity. However, 100% pre-alloyed powders are relatively expensive compared to iron powder or conventionally produced iron and it is unlikely that parts producers will accept the limited number of alloyed compositions commercially available. Accordingly, 100% pre-alloyed powders properly represent only one of several means of providing a full range of alloy preforms which are substitutional for conventionally made wrought alloy compositions.

Mechanical mixtures of iron and alloy powders, hereinafter referred to as admixtures, have been deemed capable of providing alloying during sintering of the precompact, but exactly how to achieve adequate homogenization of the alloying ingredients is not known to the prior art. The prior art recognizes that conceptually, admixtures seem to offer substantial economic advantages over 100% pre-alloyed powders. Complete flexibility should result from blending a base iron powder with a master alloy powder and thereby achieve great reduction in manufacturing costs (fuel and alloying ingredients). To arrive at this goal, there must be a different preparation of the master alloy powder and the total admixture must be designed to improve the kinetics of the sintering process.

A variety of mechanisms are at hand to produce the alloying condition by diffusion with degrees of success. For example, solid state particle diffusion can be used, diffusion resulting from gasification of one of the components to the admixture is feasible, or liquid phase sintering of the master alloy portion can be employed. The prior art (i.e. U.S. Pat. No. 2,489,838) demands solid or gas state diffusion in many cases because it was believed liquid phase diffusion caused excessive shrinkage and distortion. But this approach ignores the efficiency of alloying. Since diffusion in the solid state particle condition is limited by the number of the inner particle contacts, the hope of increasing the kinetics of complete alloying is limited. If the master alloy ingredient is converted to a gas or a liquid, there is an increase in the inner particle contact. But very few elements can be considered for the technique of gasification to one of the compounds and thus this avenue is relatively narrow in application. Therefore, there is a need for exploration and development of a method by which a master alloy powder will function by liquid phase sintering.

The use of an iron-carbon eutectic as a base for a master alloy to behave much as copper in a standard production alloy during sintering was known more than 20 years ago. (See U.S. Pat. No. 2,238,382 to Boegehold). Unlike nonferrous alloying additions, these master alloys were found to have much greater solubility. However, certain problems must be overcome if the advantageous solubility of iron-iron carbide eutectic is to be commercially utilized. The carbon in the eutectic powder diffuses out during heating before the eutectic is fully liquified thus raising its melting temperature and resulting in islands of unmelted alloy. The carbon is fixed in ratio within the eutectic powder and limits the design of different hardenability responses.

The liquid phase process must work with only two steps of compacting and heating. The ingredients of a master alloy powder must be selected with care so that each of the ingredients is compatible one with the other to liquify together in a melting range which is relatively narrow and as low as possible; the master alloy powder must have good fluidity and wetting characteristics to facilitate coating of the base ferrous powder with the alloy liquid for purposes of facilitating rapid and effective sintering and diffusion through a minimum distance. The ingredients of the master alloy must not contain deleterious amounts of elements, such as excessive silicon (see U.S. Pat. No. 3,689,257) which produces poor physical characteristics in the final product.

SUMMARY OF THE INVENTION

It is a primary object of this invention to provide an improved method for making higher quality sintered iron alloys employing a non-iron based master alloy powder which can be mixed with an iron based powder (either unalloyed or slightly prealloyed) and thereafter compacted and sintered at a reasonably low temperature to totally convert the alloy powder to a liquid phase which will diffuse into the solid iron base producing a strong, diffused compact.

Another object of this invention is to provide an improved method for making sintered iron alloys which achieves greater alloying efficiency and greater processing economy.

BRIEF OF THE DRAWINGS

FIGS. 1-3 graphically represent the variation of hardenability with carbon variation for respectively a 1.6-2% master alloy powder admixture with pure iron powder, a 2.5% master alloy powder admixture with pure iron powder, and 1.5% master alloy powder combined with a pre-alloyed iron powder containing 0.3% molybdenum.

DETAILED DESCRIPTION

Figure 1:
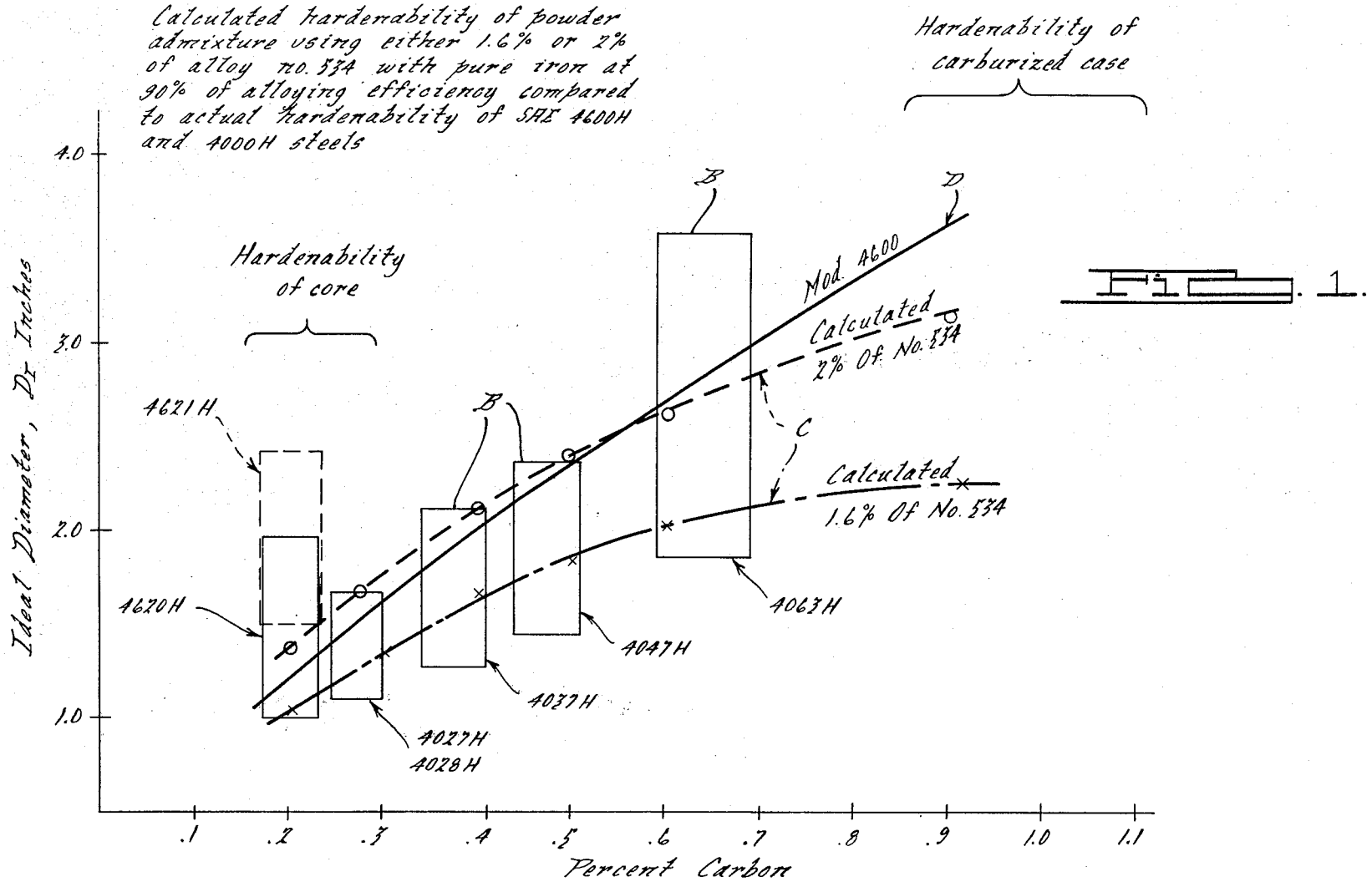

It was observed in the course of the development of this invention that adding copper to a pre-alloyed base powder, containing some molybdenum and nickel, provided a substantial increase in impact strength of the hot formed powder. It was theorized that copper, becoming liquid during sintering, coagulated the unreduced oxide films into globular or massive forms which are not detrimental to the physical properties of hot formed (forged) powder metal. The mechanical properties of the test samples containing admixed copper were equal to or superior to conventional steels of the same chemistry. The copper powder melted at 1981° F. (1083° C.) and was therefore liquid at the sintering temperature (2250° F.); it diffused quickly into the base powder increasing its hardenability (the degree to which the steel responds chosen to provide, for example in carburized steels, proper case hardness for the section involved and a tough low-carbon martensite core. Nickel, although not contributing much to hardenability such as at the 0.5% nickel level, does improve considerably the impact fatigue properties of gears and similar carburized parts.

With two groups of master alloy powders available, one multi-alloy (Mo-Mn-Cr-Ni-Fe), the other binary (Ni-Mn with copper substituted for some of the nickel), the master alloy powders can be made easily diffusible by small percentage additions of silicon (about 1–5%), rare earth metals (about 0.5–1.5%), or about 0.1% yttrium (an element that acts like rare earth for purposes of this invention). This makes it possible to provide a low alloy steel by liquid phase sintering responding to any hardenability requirement, either for quenched and drawn steel or for carburized parts. Diffusion of molybdenum, even in a small amount, increases significantly the hardenability of the case (e.g. 2½% of alloy 524 results in 0.15% Mo and $M_{fMo}=1.37$). Molybdenum is also known to overcome the difficulties associated with temper embrittlement; upwards to 0.08% Mo in the final product should be used as an alloying addition for this purpose.

Table I below summarizes nominal compositions of some master alloys pertinent to claims of this invention. It is believed the following novel features are the basis for the improvement in quality, economy of processing, alloying efficiency and liquid phase diffusion:

(a) a low carbon iron-based powder is mixed with a non-iron based alloy powder having no carbon to achieve 100% liquid phase sintering;

(b) minimal graphite powder is independently added to directly constitute the diffused carbon content of the product, provided there is relative purity of the iron and non-iron based powders;

(c) constituting more than 94% of the admixture of a powder which is economically water atomized while 6% or less of the admixture is inert gas atomized;

(d) control of the alloying ingredients within the prealloyed powder to achieve as low as possible liquidus temperature and the narrowest melting range;

(e) use of small amounts of wetting agents to improve (d); and (f) alloying only up to 0.3% Mo with the iron-based powder to achieve additional increase in speed of sintering.

TABLE I

| Master Alloy Mix No. | Chemical Composition, wt % Mn | Ni | Cr | Mo | Fe | Cu | Si | R.E. | °F. Liquidus | °F. Solidus | °F. Melting Range |
|---|---|---|---|---|---|---|---|---|---|---|---|
| 342 | 40 | 30 | 15 | 5 | 10 | — | — | — | 2140 | 1830 | 310 |
| 400 | 44 | 25 | — | 11 | 19 | — | — | — | 2200 | 2130 | 70 |
| 524 | 55 | 18 | 3 | 8 | 14 | — | 2 | — | 2065 | 1730 | 335 |
| 533 | 56 | 24 | 3 | 6 | 11 | — | — | — | 2115 | 1890 | 225 |
| 533S | * | * | * | * | * | | 2.5 | — | 2130 | 1820 | 310 |
| 533M | * | * | * | * | * | | 2.5 | 1 | 2020 | 1850 | 270 |
| 534 | 52 | 22 | 8 | 6 | 12 | — | — | — | 2110 | 2070 | 40 |
| 534S | * | * | * | * | * | — | 2.5 | — | 2070 | 1870 | 200 |
| 534M | * | * | * | * | * | — | 2.5 | 1 | 2100 | 1860 | 240 |
| 535 | 47 | 20 | 13 | 6 | 14 | — | 2.5 | — | 2210 | 2130 | 80 |
| 535S | * | * | * | * | * | — | 2.5 | 1.0 | 2100 | 1960 | 140 |
| 535M | * | * | * | * | * | — | — | — | 2145 | 1930 | 215 |
| 528 | 75 | 25 | — | — | — | — | — | — | 1930 | 1800 | 130 |
| 527 | 74 | 12.5 | — | — | — | 12.5 | 1 | — | 1940 | 1700 | 240 |
| 344 | 36 | 30 | 18 | 6 | 10 | — | — | — | 2205 | 2005 | 200 |
| 345 | 41 | 25 | 18 | 6 | 10 | — | — | — | 2220 | 1970 | 250 |
| 346 | 38 | 23 | 18 | 6 | 15 | — | — | — | 2245 | 2000 | 245 |
| 506 | 64 | 16 | 0 | 10 | 10 | — | — | — | 2250 | 1955 | 290 |
| 508 | 56 | 14 | 0 | 15 | 15 | — | — | — | 2300 | 2000 | 300 |
| 509 | 56 | 14 | 15 | 5 | 10 | — | — | — | 2170 | 2070 | 100 |
| 510 | 56 | 14 | 10 | 10 | 10 | — | — | — | 2240 | 2015 | 225 |
| 511 | 59 | 11 | 15 | 5 | 10 | — | — | — | 2280 | 2040 | 240 |
| 512 | 53 | 17 | 15 | 5 | 10 | — | — | — | 2220 | 2000 | 220 |
| 513 | 56 | 14 | 22 | 8 | — | — | — | — | 2435 | 1920 | 515 |
| 514 | 50 | 20 | 15 | 5 | 10 | — | — | — | 2200 | 2090 | 110 |
| 515 | 46 | 24 | 15 | 5 | 10 | — | — | — | 2200 | 1990 | 230 |
| 531 | 72 | 14 | — | — | — | 14 | 2 | — | 1910 | 1770 | 140 |
| 532 | 72 | 14 | — | — | — | 14 | — | 1 | 2020 | 1790 | 230 |

*The same above percentages as immediately above except reduced proportionately for the presence of silicon and/or rare earths.

EXAMPLES

A. Master Alloy No. 343

Master Alloy No. 342 was made using an inert gas atomizing technique and was screened to −200 mesh size. Its composition is given in Table I. Pure iron, water atomized powder (Atomet 28, Quebec Metal Powders oxygen content 0.25 max., and other impurities less than 0.75%) was mixed with 2½% addition of the prepared master alloy powder, four different levels of natural graphite (No. 1651), and 1% Acrawax to provide die lubrication. The admixture was compacted into 3" diameter slugs and sintered in hydrogen atmosphere at 2250° F. (1232° C.). The slugs were reheated by induction to 1800° F. (982° C.) in a protective nitrogen gas atmosphere and were hot formed into 4" diameter (100 mm) flat 1.1" (28 mm) thick cylinders, with a density close to 100%. Jominy hardenability bars and tensile and impact bars were prepared from these hot formed slugs.

The chemical composition of the bars was determined by X-Ray fluorescence and was 1.02% Mn; 0.14% Mo; 0.82% Ni, 0.42% Cr, the remainder iron.

Hardenability of the alloy was calculated using a 50% martensite criterion; hardenability also was determined experimentally from standard Jominy 1" diameter (25 mm) bars that were run using standard SAE procedure.

| % Carbon | Ideal Diameter $D_I$ Calculated | Ideal Diameter $D_I$ Experimental | Premix Alloying Efficiency |
|---|---|---|---|
| .20 | 1.57 | 1.15 | 73% |
| .31 | 2.15 | 1.88 | 87% |
| .68 | 3.26 | 2.8 | 78% |

$$\text{Premix alloying efficiency} = \frac{D_I \text{ Experimental}}{D_I \text{ Calculated}} \times 100\%$$

Mechanical test results of samples containing 0.31% carbon and quenched and tempered to hardness of Rockwell C 26 were: Ultimate tensile strength—119 k.s.i (820 MPa); Yield point 101 k.s.i. (696 MPa); Elongation—24%; and Reduction of area 48% V-notch Charpy impact test, 10 mm square test bar, was 39 ft. lbs. (53 Joules) at −60° F. (651° C.), 34 ft. lbs. (45 Joules) at OF 9°-18° C.) and 45 ft. lbs. (61 Joules) at 75° F. 923° C.).

B. Master Alloy No. 400

Master Alloy No. 400 was atomized using inert gas method and screened to −200 mesh particle size. It was mixed with pure iron powder and the experimental procedure was identical to that described above for Alloy No. 342.

The chemical composition of the hot formed slugs was 1.09% manganese; 0.26% molybdenum; 0.73% nickel; and 0.04% chromium and 0.03 copper, the remainder iron.

Hardenability of the alloy was both calculated using a 50% martensite criterion and was determined experimentally using standard 1" diameter (25 mm) bars as per SAE procedure.

| % Carbon | Ideal Diameter $D_I$ Calculated | Ideal Diameter $D_I$ Experimental | Admixture Alloying Efficiency |
|---|---|---|---|
| .16 | 1.41 | 1.30 | 93% |
| .21 | 1.71 | 1.40 | 82% |
| .31 | 2.22 | 1.70 | 77% |
| .69 | 3.38 | 2.70 | 80% |

$$\text{Premix alloying efficiency} = \frac{D_I \text{ Experimental}}{D_I \text{ Calculated}} \times 100\%$$

Mechanical test results of 0.31 carbon sample quenched and tempered to hardness 25 Rockwell C were: Ultimate tensile strength—119 k.s.i. (820 MPa); Yield point—104 k.s.i. (717 MPa); Elongation—26%; and Reduction of Area—53%. V-notch Charpy impact test on 10 mm square bar was 23 ft. lbs. (31 Joules) at −60F. (−51C.); 48ft. lbs. (65 Joules) at OF (−18C.); and 50 ft lbs. (68 Joules at 75F. (23C.).

C. Master Alloy No. 524

Multi-element master alloy No. 524 was atomized, using the inert gas method, and screened to −200 mesh particle size. It was mixed with pure water atomized iron powder and pure graphite powder; the experimental procedure was identical to that described above for alloy No. 342.

The chemical composition of the master alloy was 2.7% chromium, 7.79% molybdenum, 56.48% manganese, 14.29% iron, 18.10% nickel and 2% silicon. Two and one-half percent of this master 524 alloy was admixed with the pure iron powder to produce a final composition in the powder metallurgy sintered steel as follows: 1.41% manganese, 0.45% nickel, 0.07% chromium, 0.19% molybdenum.

Hardenability of the alloy was calculated using both 50% and 90% martensite criterion and was determined experimentally using standard 1" diameter (25 mm) bars as per SAE procedure.

| % Carbon | Ideal Diameter $D_I$ Calculated 50% Martensite | Actual Ideal Diameter 50% Martensite | Actual Ideal Diameter 90% Martensite | Admixture Alloying @50% Mart. |
|---|---|---|---|---|
| .23 | 2.17 | 1.88 | 1.56 | 87% |
| .29 | 2.45 | 2.55 | 2.13 | 104% |
| .39 | 3.08 | 3.55 | 1.96 | 83% |
| .81 | 4.15 | 4.10 | 2.88 | 99% |

The maximum scatter of hardness readings from the mean jominy curve was ±2.5 Rockwell "C" points.

The three premixes, using 2.5% (although the operable range for this invention is 0.25–6%) of either master alloy #342, #400, or 524 exhibited good diffusion of the alloying elements into the pure iron powder. Hardenability was equal or superior to that of the now popular MOD—4600 low alloy prealloyed steel powder. While alloy #400 exhibited almost complete dissolution in the matrix as observed in its microstructure, the premix with alloy #342 has shown some very small areas of undissolved residual master alloy.

Hardenability as judged by $D_I$ using 50% martensite criterion for both alloys 342 and 400 is 70–90% (even higher for 524) of that calculated for conventional, prealloyed steels of the same chemical composition; this is considered very satisfactory. There is, however, a drop-off of hardness at the beginning of jominy curves and $D_I$ using 90% martensite criterion is much lower for a premix with alloy #342 than with #400. Thus, alloy #400 appears to be superior to #342, as its $D_I$ value for 90% martensite is only somewhat inferior to the value of 50% martensite. A narrower melting range for alloy #400 will result in better liquidity and diffusion; thus sintering at temperatures higher than 2250° F. will result in still higher hardenability due to better dissolution of alloying elements.

The three premixes have shown mechanical properties, impact strength and ductility close to that of modified 4600 hot formed powder metal prealloyed steel sintered in hydrogen at 2250° F. These properties are usable for many heavy duty engineering applications.

Certain precepts for this invention with respect to the chemical make-up of the alloyed master powder are: (a) molybdenum should be in the range of 5–11% when selected along with the substantial absence of copper, (b) molybdenum and chromium as a combination should not be greater than 25%, (c) iron should be in the range of 1–40%, (d) no greater than 5% of silicon and rare earths, and (e) at least 40% manganese is preferred when 5% or more iron is employed to obtain an increase in hardenability, but up to 2.5% of the manganese can be replaced by silicon. Preferred ranges for the chemical make-up of a quaternary alloyed powder are: Ni 20–30%, Mn 40–54%, Mo 5–11%, Fe 10–20%, Cr 0.05–16%. The base iron powder should preferably contain no greater than 1% other alloying ingredients.

The properties outlined in the above three examples also compare favorably with conventional steels and are considered as entirely satisfactory for many engineering applications.

D. Influence of Silicon and Rare Earth Metal Additions to the Master Alloy Powders on the Hardenability of Powder Metal (P/M) Steels.

Master alloys of very similar chemical composition were made with and without the additions of silicon and rare earth metals. Two and one-half percent of master alloys were premixed with water atomized pure iron powder and graphite powder, sintered at 2250° F. (1232° C.) and hot formed. Jominy bars were tested for hardenability as per SAE procedure. Favorable influence of silicon and rare earth metal additions on liquid phase sintering and diffusion of master alloys are reflected in a very significant improvement of hardenability at about 0.2% carbon level as shown below:

| Group | Master Alloy No. | Addition of Silicon or Rare Earth | Carbon Weight Percent | Ideal Diameter 50% Martensite | Ideal Diameter 90% Martensite |
|---|---|---|---|---|---|
| 1 | 527** | None | 0.22 | 1.45 | 1.12 |
| | 531 | Silicon | 0.22* | 1.67 | 1.21 |
| | 532 | Rare Earth | 0.22 | 2.30 | 1.90 |
| 2 | 400 | None | 0.22 | 1.40 | 1.20 |
| | 400S | Silicon | 0.22 | 1.88 | 1.40 |
| 3 | 342 | None | 0.21 | 1.15 | 0.72 |
| | 530 | Rare Earth | 0.21 | 1.40 | 1.23 |

*Hardenability corrected to the indicated carbon level.
**Premix with 2.5% of alloy No. 527 without any silicon or rare earth exhibited a considerable scatter of hardness from the mean average Jominy hardenability curve.

P/M alloy steels made by premixing of master alloys showed a less smooth Jominy curve than a corresponding prealloyed steel due to the changes in the microcomposition of the matrix. It was observed that the additions of silicon, and to a smaller extent additions of rare earth metals decrease the extent of the scatter, which is an indication of improved diffusion.

E. Examples of Substitutability of P/M Steels taught herein for Conventional Steels on the Basis of Hardenability.

I. Substitution of P/M Unalloyed Powder Admixtures for SAE 4000H and 4600H Steels.

Figure 2:
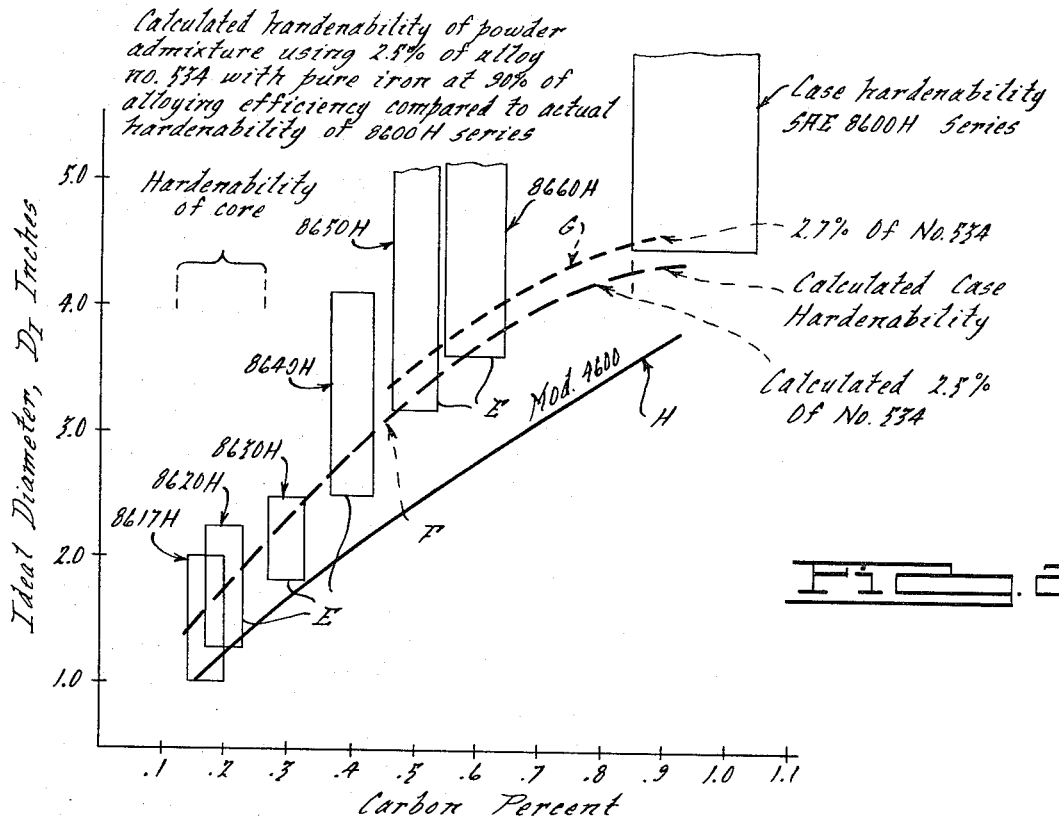
Figure 3:
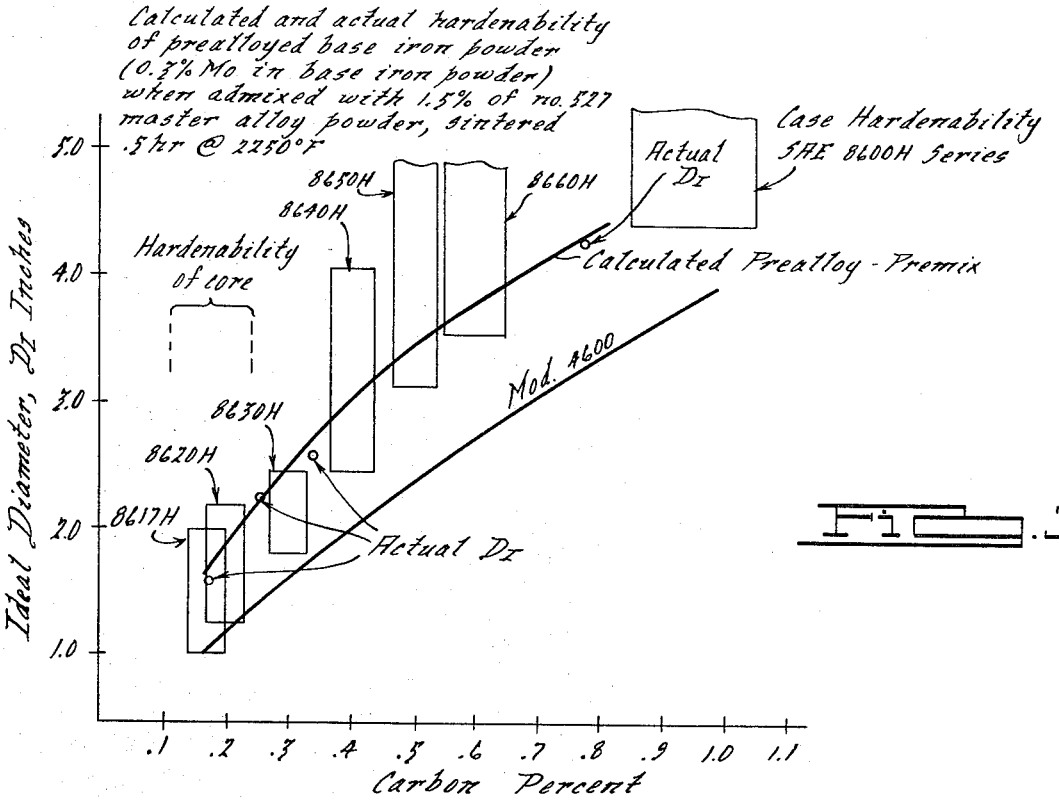

It was demonstrated that the master alloy powders with additions of silicon and rare earth metals can achieve approximately a 90% alloying efficiency (i.e. the P/M alloy after sintering and hot forming having hardenability, as expressed by $D_I$, equal to 90% of the hardenability of a prealloyed steel of equivalent chemistry), sintering being performed for 0.5 hrs. at 2250° F. (1232° C.) in an atmosphere low in oxygen potential. Sintering could be shorter with a higher sintering temperature. FIG. 1 shows the actual hardenability zones for several 4000H and 4600H SAE series steels and shows calculated hardenability curves C for 1.6% and 2.0% additions of master powder alloy powder No. 534 (see Table I) when mixed with a pure iron base powder. The coordinates of the graph of FIGS. 1–3 are as follows: the ordinate axis represents hardenability as expressed by ideal diameter ($D_I$) in inches and the abscissa represents the carbon content. The hardenability of conventional steels is represented by rectangles (zones B), the vertical lines of the rectangle limiting the carbon of the SAE specification and the horizontal lines limiting the calculated minima and maxima of the ideal diameters for these steels. One can say that whenever the scatterband of the hardenability of premixes crosses both vertical sides of the rectangle the P/M steel will be fully equivalent to the conventional steel with regard to hardenability. For simplicity, calculated lines of hardenability values ($D_I$) at the above-mentioned percentages of premix were plotted for different carbon levels. The hardenability of premixes can be more closely controlled than that of the conventional steels by varying the amount of the master alloy powder. For example, a premix containing 1.6% of master alloy powder No. 534 is satisfactory as a substitute for the SAE 4000H series since the curve crosses both sides of each zone. Approximately 2% of the same master alloy powder is required when substituting for SAE 4620H or modified 4600 (see calculated curve D) prealloyed P/M steel in order to obtain an equivalent hardenability both of the case and of the core.

II. Substitution of P/M Unalloyed Powder Admixtures for the Popular SAE 8600H

FIG. 2 represents the actual hardenability of SAE 8600H series of steel zones E and the calculated hardenability of a 2.5% admixture of powder alloy No. 534 and pure iron powder (curve F) assuming 90% alloying efficiency after 0.5 hrs. of sintering at 2250° F. (1232° C.) in a low oxygen potential atmosphere. It can be seen that this proportion admixture (2.5% of 534) has a significantly higher hardenability than the now popular modified 4600 P/M steel (see curve H) and results in a good substitution for the 8630 and 8640H steels. While the core hardenability is in the middle of the SAE 8617 and 8620H rectangles, the hardenability of the case for these steels is slightly below the hardenability of the 8600H series of the steels. This is due to the fact that the conventional steel contains 0.20 to 0.35% Si while the P/M steel contains only residual silicon. Silicon contributes significantly to hardenability at a high carbon content of increases the hardenability of the case of conventional steels by 15–25%. The slightly inferior value of the case hardenability for a 2.5% premix addition is not considered to be of significance for smaller parts, as the majority of the new EX- series of low alloy steels as a substitute for the SAE 8600H series (which are now finding wide acceptance) have a $D_I$ hardenability of the case on the average of 0.4 inches below that of the SAE 8600H series. Except for larger components, this is of no consequence. The SAE steels 8650H and 8660H require slightly more master alloy: 2.7% of alloy No. 534 (see curve G) will be a satisfactory substitution; it will also give for 8617 and 8620H steels a case hardenability within the range of the 8600H series.

F. Prealloyed Base Powder—Master Alloy Powder Combination.

As determined and outlined in previous paragraphs, manganese is the fastest diffusing element while nickel, chromium and molybdenum, in the conditions examined, were only about one-third as fast as manganese. It is economically advantageous to make alloys of the highest hardenability in the following way: Use a base powder (identified No. 133) containing a prealloyed 0.3% molybdenum content only and no other alloying elements. Such a powder is easy and economical to manufacture as molybdenum is more noble than iron with regard to oxidation and any molybdenum oxides will be reduced during the powder annealing operation after water atomization. To this base powder one can admix any high manganese master alloy powder containing also some nickel and/or copper with wetting and diffusion promoting agents such as silicon, rare earth or yttrium but without molybdenum and chromium. Even alloy No. 527, which did not contain any of the above-mentioned wetting or diffusion agents, and which was added in the proportion of 1.5% to a prealloyed base iron powder No. 133, gave an alloying efficiency close to 100% as shown in the table below and in FIG. 3, even though the Jominy curves have shown some undesirable scatter. This scatter could be minimized by the addition of silicon, rare earth metals and yttrium to this master alloy. The graphical representation of hardenability in FIG. 3 demonstrates the advantages of using a prealloy-premix combination to adapt the hardenability for a particular engineering application. Molybdenum is an important alloying element which has a considerably higher multiplying factor at high carbon content than at low carbon level. Thus molybdenum is an important element in the carburizing grade of steels. Iron base powders, water atomized by the nature of the P/M process, cannot contain any silicon, as silicon during water atomization will be preferentially oxidized and creates irreducible silicon oxide films which prevent sintering and degrade the properties of hot fomed P/M steels. As explained in Example E, silicon contributes significantly to the case hardenability during carburizing; molybdenum is another element which has similar properties in this respect. Thus in the absence of silicon, to obtain a high core and case hardenability, molybdenum is the most desirable element to employ in the base iron powder.

In FIG. 3, calculated hardenability curve J was for a 1.5% of powder No. 527 admixed with graphite into the iron base powder (No. 133) containing 0.30% molybdenum only. The resultant chemical composition for the resulting P/M steel was 1.30% manganese, 0.165% nickel, 0.164% copper and 0.30% molybdenum. Jominy bars were prepared and tested using the procedure described in example A and the results were as outlined below:

| | Hardenability - Ideal Diameter, Inches | | | Alloying |
|---|---|---|---|---|
| % Carbon | Experimental 50% Martensite | Experimental 90% Martensite | Calculated 50% Martensite | Efficiency 50% Martensite |
| 0.175 | 1.60 | 1.48 | 1.68 | 95% |
| 0.255 | 2.25 | 2.03 | 2.22 | 101% |
| 0.34 | 2.60 | 2.22 | 2.75 | 94% |
| 0.78 | 4.79 | 4.27 | 4.30* | 99%* |

*90% martensite criterion.

The above figures show that very high alloying efficiency approaching 100% is achieved using as a base prealloyed powder with molybdenum as the only alloying element and a manganese-rich master alloy. It can be seen from FIG. 3 that this alloying combination in the proportions used was equivalent to the SAE 8600H series of steels. FIG. 3 shows both calculated (see L) and experimental (zones K) values of hardenability as expressed by Ideal Diameter.

The master alloy powder premix of this invention is particularly helpful when working with molybdenum which requires delicate control to get good response. Molybdenum has a large atomic radius and this is difficult to diffuse readily between iron atoms unless precise controls are employed. The absence of copper facilitates the molybdenum diffusion as well as the carbon control.

I claim:

1. A method of establishing alloying between solid and liquid phases of a powder mixture, comprising:

(a) uniformly blending an iron based powder, devoid of alloying ingredients and having less than 1% impurities, with a prealloyed non-iron based additive powder devoid of alloyed carbon to form a mixture, said additive powder consisting of at least two elements, but up to all elements selected from the group consisting of manganese, molybdenum, nickel, chromium, copper and iron, molybdenum being in the range of 5–15% by weight when selected along with the absence of copper, said elements being selected and balanced to provide in step (c) a span of melting temperatures for said admixture of elements of no greater than 350° F. and the admixture having a liquidus temperature of between 1900° F.–2250° F., said additive powder being preset in an amount of 0.25–6% of said mixture, (b) adding a predetermined amount of graphite powder to said mixture to render 0.81% carbon or less and to render a predetermined hardenability response upon heating in step (c), and (c) heating said mixture to a predetermined temperature and for a period of time to allow the additive powder to completely form a liquid phase which readily diffuses along the particle boundaries and into the matrix of said iron powder thereby reducing the maximum diffusion distance to one particle radius or less and provides for a homogeneous microstructure.

2. The method as in claim 1, in which iron is selected in the range of 10–20% when effective amounts of molybdenum and/or chromium are present in the non-iron based powder, said iron content being twice the molybdenum content.

3. A method of making a sintered metallic compact by use of a multi-component alloy powder, comprising:

(a) uniformly blending an iron based powder, having less than 1% impurities with a non-iron based alloyed powder having less than 0.5% impurities to form a mixture, said alloyed powder consisting essentially of at least two elements selected from a first group consisting of manganese, molybdenum, nickel, chromium, copper and iron, and up to two elements selected in a total quantity of no greater than 5.0% by weight of a group cosisting of silicon and rare earth elements, with silicon being equal to or less than 2.5% when selected, the non-iron base alloy being present in an amount of 0.25–6% of said mixture, (b) compacting said powders along with a desired amount of graphite to render a desired hardenability response to the compact and to form a shape having a theoretical density of the order of 80% or greater, (c) heating said shape to a temperature of about 2250° F. for a period of time no greater than 1 hour to liquify said alloyed powder to a liquid phase while maintaining said iron based powder substantially in a solid phase and to effect diffusion of said liquid phase into or onto substantially all particles of said solid phase to provide for greater compositional uniformity, and (d) allowing said shape to cool, said shape having a hardenability response substantially equal to a wrought steel shape or a sintered metal shape made from only prealloyed powder with the latter shapes having a chemistry substantially metallurgically equivalent to the product of this method.

4. The method as in claim 3, in which the elements for said alloyed powder selected from the first group form a quaternary alloy, with the elements limited to Ni 20–30%, Mn 40–54%, Mo 5–11%, Fe 10–20%, Cr.

0.05–16%, the mechanical strength properties of the resulting product being equal to or better than a wrought steel of equivalent chemistry.

5. The method as in claim 3, in which the elements selected from the first group form a binary alloy powder, with the elements limited to Mn 70–75%, 25–30% Ni.

6. The method as in claim 3, in which the elements selected from the first group along with required ranges are Ni 20–30%, Mn 40–54%, Mo 5–11%, Fe 10–20%, Cr 0.05–16%, graphite being added to provide about 0.3% carbon and the mechanical properties of the resulting product being characterized by an ultimate tensile strength of at least 115 k.s.i. and a charpy V-notch value at —60% of about 23 and at +75° F. of about 45, at a hardness of 25 $R_c$.

7. A method for the manufacture of sintered alloy steel parts, characterized by compaction and sintering of an admixed powder having carbon in graphite powder form to obtain alloying, the admixture consisting of two powder types, one type being an iron based powder substantially devoid of alloying ingredients, and the other type being an alloying powder capable of sintering by formation of a low-melting point phase, said alloying powder consisting of at least three elements, two of said elements being selected from the group consisting of manganese, nickel, molybdenum, chromium, molybdenum when selected being no greater than 11% and the combination of molybdenum plus chromium when selected being no greater than 30%, the third element constituting iron in the range of 1–40% said alloyed powder constituting 0.25–6% of said admixed powder.

8. The method as in claim 7, in which said alloyed powder consists of said 14% nickel, about 56% manganese, about 15% chromium, about 5% molybdenum, and about 10% iron, the admixture having a liquidus of about 2170° F., a solidus of about 2070° F., and a melting range of 100° F.

9. The method as in claim 7, in which said alloyed powder consists of 22% nickel, 52% manganese, 8% chromium, 6% molybdenum and 12% iron, the admixture having a liquidus of about 2100° F., a solidus of about 1860° F., and a melting range of 240° F., to the above constituency 2.5% silicon and 1% rare earth metals is prealloyed.

10. A method of producing a sintered metallic compact, comprising:

(a) uniformly blending graphite powder, an iron based powder with an alloyed powder to form a mixture, said alloyed powder constituting 0.25–6% of said mixture and containing at least three elements selected from the group consisting of manganese, molybdenum, nickel and chromium, said manganese constituting at least 40% of said alloy powder and nickel constituting at least 5% of said alloy powder, said graphite being present in an amount effective to provide a predetermined carbon content in the resulting product, (b) compacting said mixture into a shape having a theoretical density of the order of 80%, and (c) heating such shape in the environment of a reducing atmosphere to a temperature in the range of 1800°–2200° F., for a period of time to liquify said alloy powder present in said mixture and thereby form a low melting liquid phase, and then allowing said shape to cool.

11. The method as in claim 10, in which said alloyed powder further contains at least 1–40% iron in addition to said three elements.

12. The method as in claim 11, wherein said prealloy powder contains at least 5–40% iron and at least 50% manganese.

13. The method as in claim 11, in which said chromium constitutes at least 12% of said alloy powder.

14. A method as in claim 11, in which said alloy powder particularly comprises about 30% nickel, 40% manganese, 5% molybdenum, 15% chromium and about 10% iron, the admixture having a liquidus of about 2140° F. and a solidus of 1830° F.

15. The method as in claim 11, in which said alloyed powder is particularly comprised of about 27% nickel, 45% manganese, 10% molybdenum and about 18% iron.

16. The method as in claim 10, in which forming pressure is applied to said shape while being heated in step (c).

17. A method of establishing alloying between solid and liquid phases of a powder mixture, comprising:

(a) uniformly blending a water atomized, iron based powder, devoid of alloying ingredients except for molybdenum which is prealloyed therewith in the range of 0.08–0.4% by weight, with a non-iron based additive powder consisting of alloying ingredients and having no greater than 14% copper and having at least two other elements but up to all elements selected from the group consisting of manganese, nickel, chromium, and iron, said two elements being selected and balanced to provide a span of melting temperatures for said admixture of no greater than 350° F. and the admixture having a liquidus temperature of between 1900°–2250° F., said additive powder being present in an amount of 0.25–6% of said mixture, (b) compacting said mixture to a density of at least 70%, and (c) heating said compacted mixture to a temperature of about 2250° F. for no greater than one hour, whereby the additive powder forms a liquid phase which readily diffuses along the particle boundaries and into the matrix of said iron powder thereby reducing the maximum diffusion distance to one particle radius or less.

18. A method for the manufacture of sintered alloy steel parts, characterized by the compaction and sintering of an admixed powder to obtain alloying, the admixture consisting of three powder types, one type being a low carbon iron based powder substantially devoid of alloying ingredients except for up to 1% of said alloying ingredients, another type being an alloy base powder capable of sintering by formation of a low-melting point liquid phase, said alloy base powder consisting of at least three elements, two of said elements being selected from the group consisting of manganese in the range of 40–60%, nickel, molybdenum, and chromium, and the third element constituting iron in the range of 1–40% and said third powder being graphite in an amount to directly constitute the desired carbon content of said sintered steel part.

* * * * *